United States Patent [19]

Crenshaw

[11] Patent Number: 4,955,117

[45] Date of Patent: Sep. 11, 1990

[54] APPARATUS FOR HOT AIR BULKING OF SYNTHETIC YARN

[75] Inventor: Edward L. Crenshaw, Inman, S.C.

[73] Assignee: Milliken Research Corporation, Spartanburg, S.C.

[21] Appl. No.: 78,058

[22] Filed: Sep. 4, 1987

Related U.S. Application Data

[62] Division of Ser. No. 26,656, Mar. 17, 1987, abandoned.

[51] Int. Cl.[5] ..... D02J 1/02

[52] U.S. Cl. ..... 28/281

[58] Field of Search ..... 28/281, 248, 249; 8/149.2, 149.3; 19/299; 34/49; 26/74; 68/20

[56] References Cited

U.S. PATENT DOCUMENTS

| | | | |
|---|---|---|---|
| 2,736,676 | 2/1956 | Frickert, Jr. | 19/299 X |
| 3,126,556 | 3/1964 | Fleissner | 28/281 X |
| 3,318,013 | 5/1967 | Erb | 28/281 X |
| 3,728,076 | 4/1973 | Fleissner | 28/281 X |
| 3,785,017 | 1/1974 | Jacob et al. | 28/281 |
| 3,833,975 | 9/1974 | Cahnman et al. | 28/281 |
| 3,835,490 | 9/1974 | Fleissner | 8/149.3 X |
| 3,943,613 | 3/1976 | Schraud et al. | 8/149.3 X |
| 3,965,511 | 6/1976 | Fleissner | 28/281 X |
| 4,077,097 | 3/1978 | McNeill | 28/281 |
| 4,083,091 | 4/1978 | McNeill | 28/281 |
| 4,169,707 | 10/1979 | Gloeckler | 28/281 X |
| 4,221,031 | 9/1980 | Gilbos | 28/281 |
| 4,694,526 | 9/1987 | Grafen et al. | 26/74 X |

FOREIGN PATENT DOCUMENTS

| | | | |
|---|---|---|---|
| 564761 | 10/1958 | Canada | 8/149.3 |
| 1905730 | 9/1970 | Fed. Rep. of Germany | 8/149.3 |
| 1602027 | 11/1970 | France | 28/281 |
| 4640515 | 11/1971 | Japan | 28/281 |

OTHER PUBLICATIONS

PCT/FR85/00049, 09/1985, WO85/04198 28 281 4 25.

*Primary Examiner*—Werner H. Schroeder

*Attorney, Agent, or Firm*—Earle R. Marden; H. William Petry

[57] ABSTRACT

Synthetic yarn to be bulked and heat set is supplied to a plurality of ovens in coiled form and is subjected to an even hot flow of dry gaseous fluid to bulk and heat set the yarn as it passes successively through the bulking oven and the heat setting oven. Safety controls are provided to prevent damage to the yarn when the conveying system is shut down and the yarn is being conveyed through the system.

6 Claims, 4 Drawing Sheets

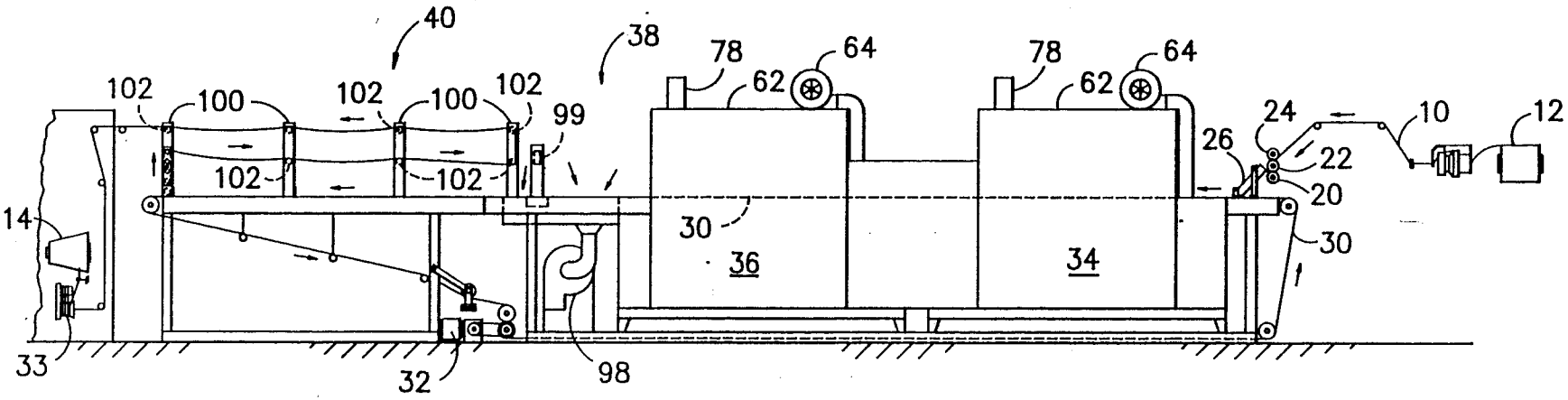
FIG. — 1 —

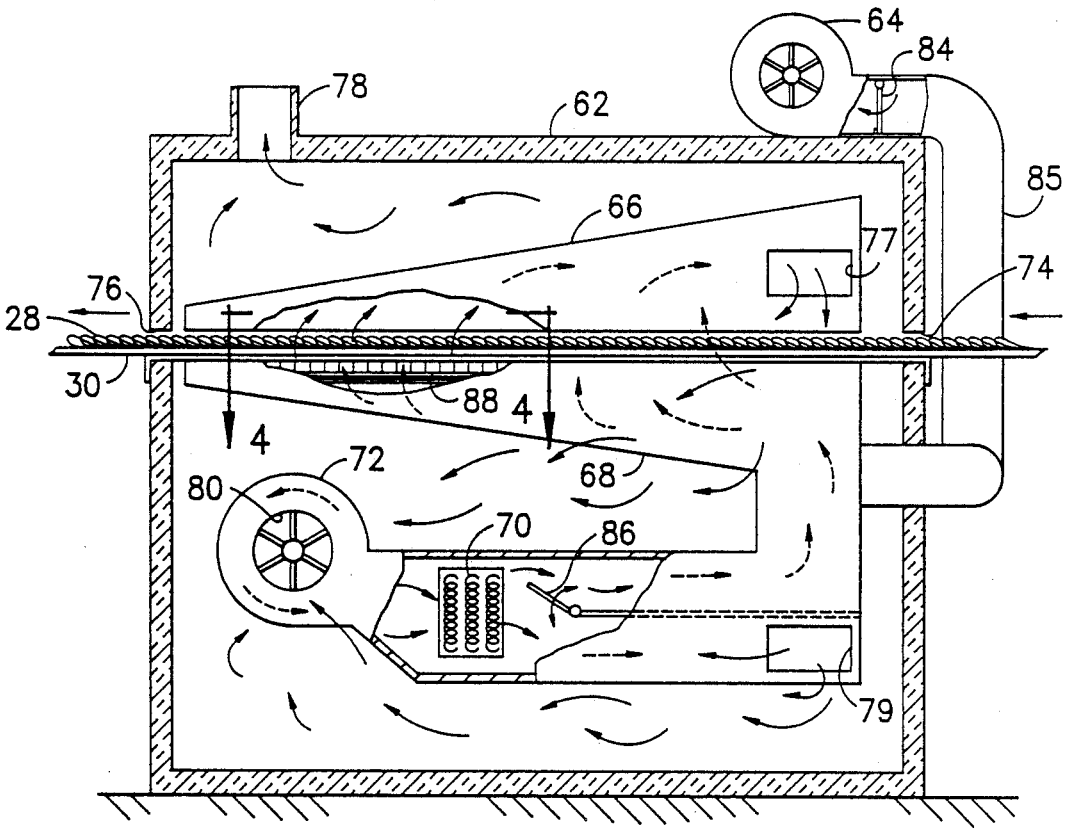
FIG. – 2 –
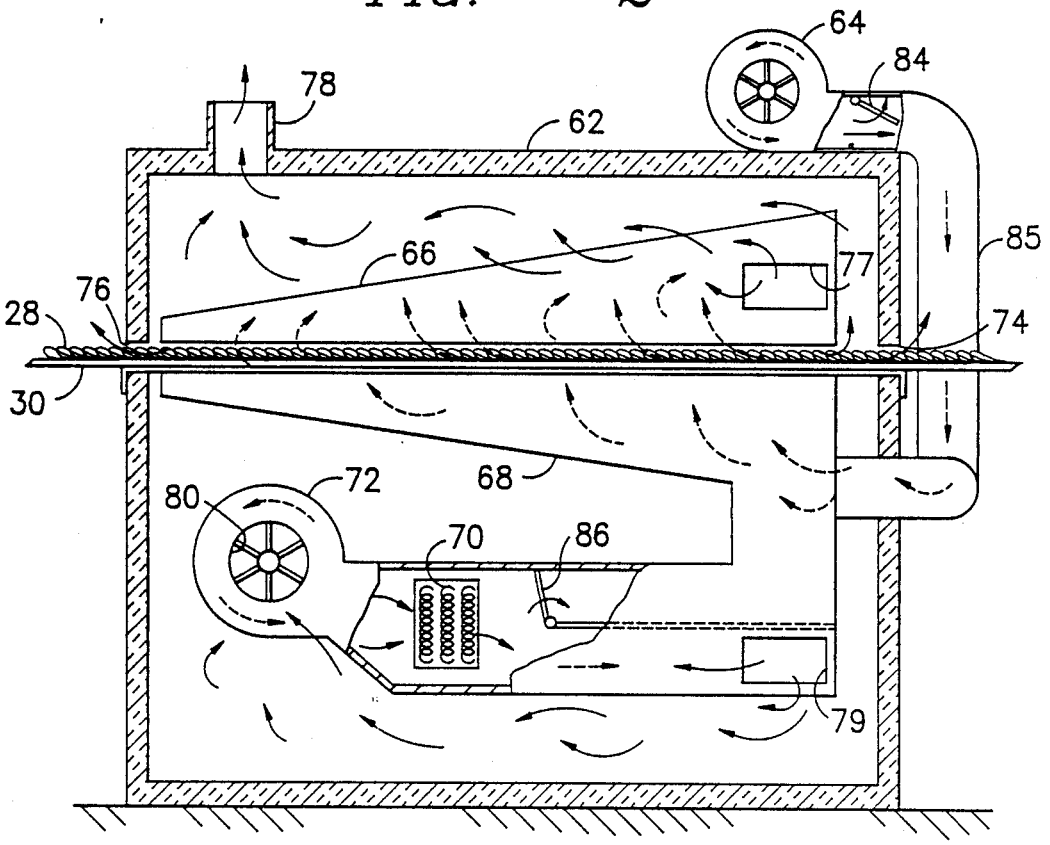
FIG. – 3 –

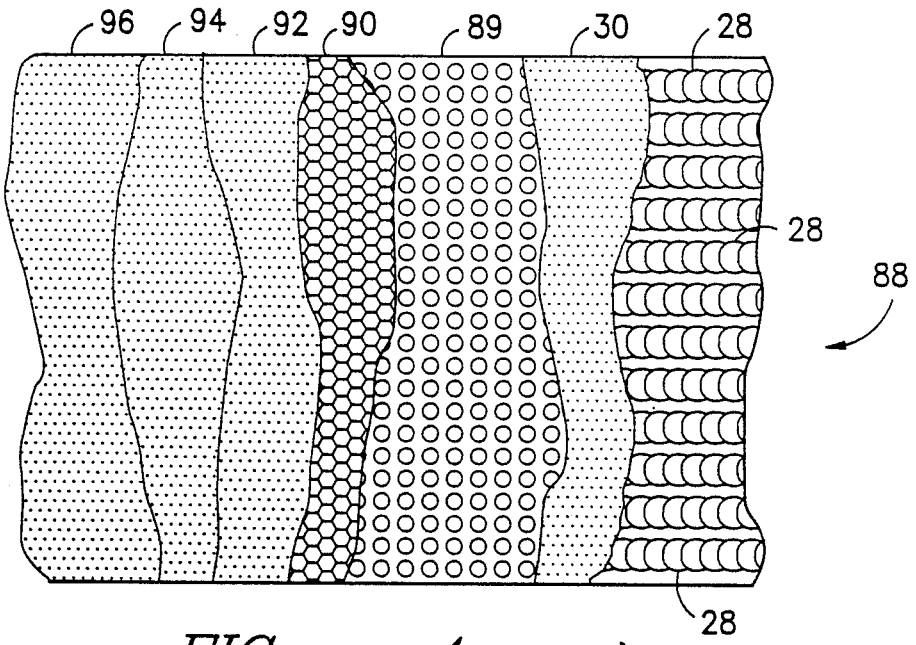
FIG. — 4 .—
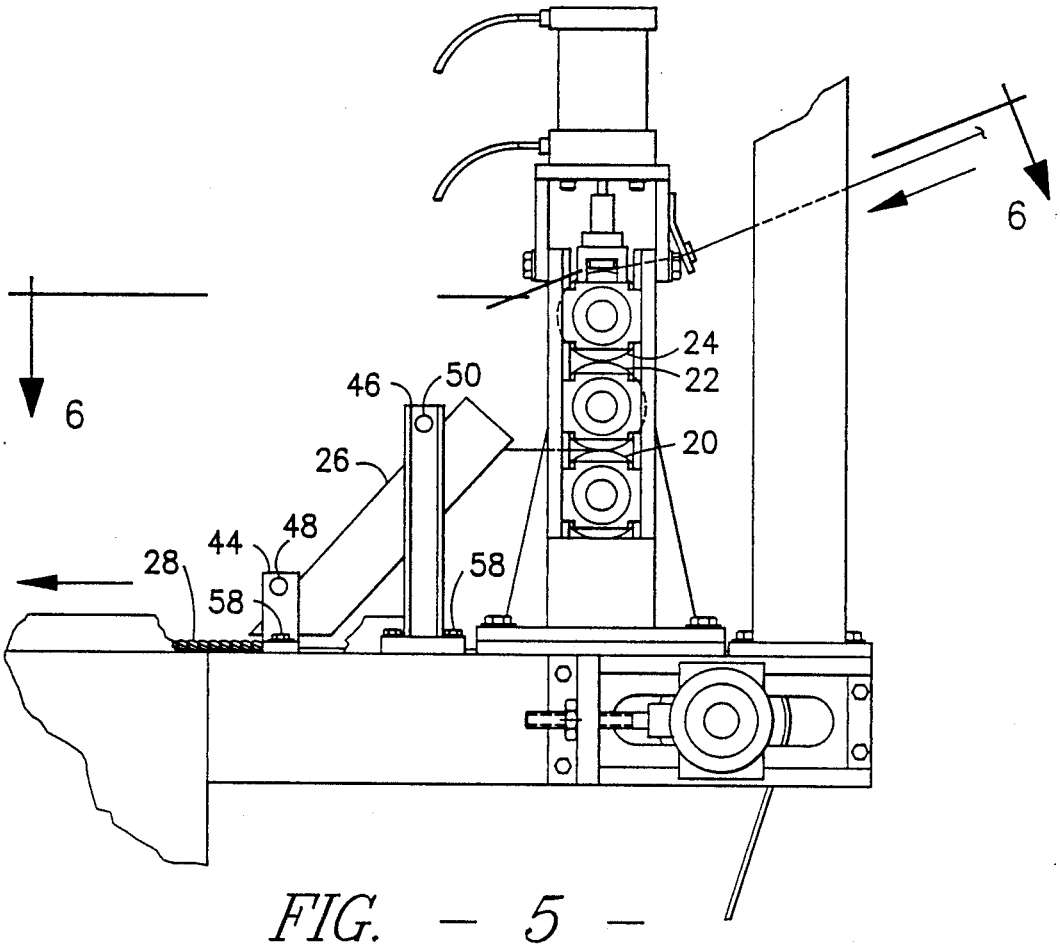
FIG. — 5 —

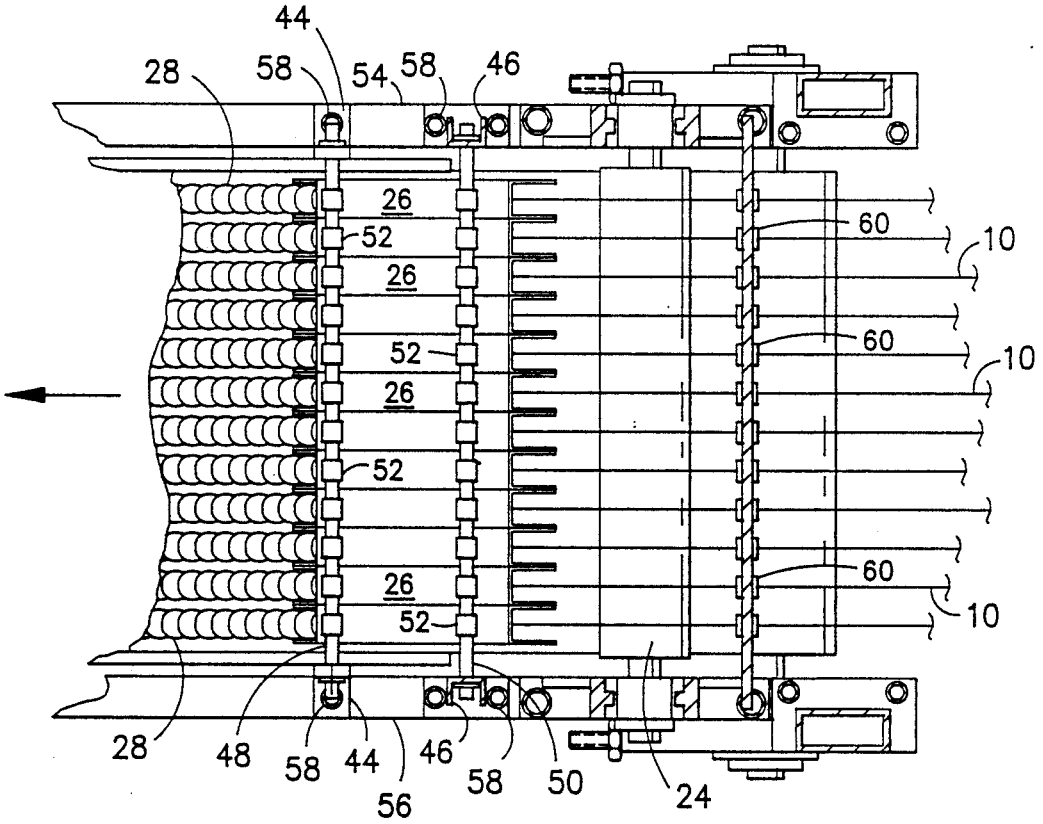
FIG. – 6 –
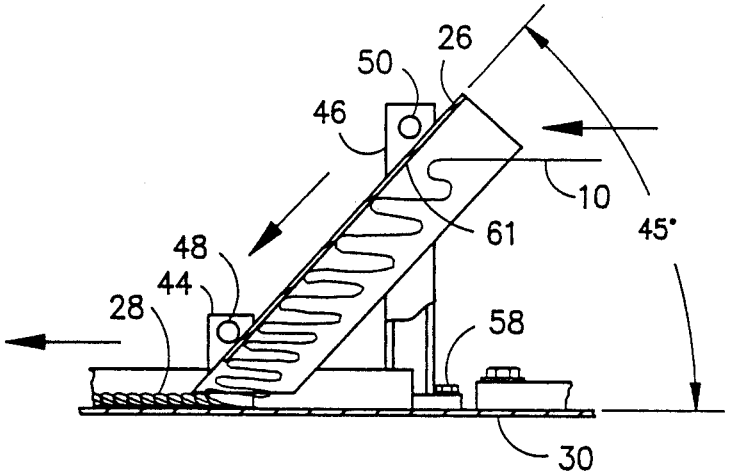
FIG. – 7 –

APPARATUS FOR HOT AIR BULKING OF SYNTHETIC YARN

This is a division of application Ser. No. 026,656 filed Mar. 17, 1987, now abandoned.

This invention relates to a method and apparatus to efficiently bulk and heat set synthetic yarn. Preferably, the method is directed to the use of dry, hot air but other mediums, such as superheated steam, can be employed so long as the moisture content of the bulking fluid is low.

It is, therefore, an object of the invention to provide a method and apparatus to efficiently bulk and heat set synthetic yarn of continuous filament and/or staple fibers.

Other objects and advantages of the invention will become clearly apparent as the specification proceeds to describe the invention with reference to the accompanying drawings, in which:

FIG. 1 is a schematic representation of the overall apparatus to provide a bulked, synthetic yarn;

FIG. 2 is a cross-section of one of the bulking or heatsetting ovens shown schematically in FIG. 1;

FIG. 3 is a view similar to FIG. 2 showing the oven when the conveyor belt has been stopped;

FIG. 4 is a view taken on line 4—4 of FIG. 2 showing the baffling for diffusing the supply air in the oven with parts broken away for clarity;

FIG. 5 is a side view of the yarn feed roll arrangement;

FIG. 6 is a top view taken generally on line 6—6 of FIG. 5; and

FIG. 7 is a cross-section view of one of the yarn deflectors and coiling chutes shown in FIGS. 5 and 6.

Looking now to FIG. 1, the overall bulking system is shown. The yarn 10, preferably BCF (bicomponent filament) nylon 6 or 66 in staple or continuous filament form, is supplied at a speed of 1000–2000 feet/minute from a plurality of packages 12 and taken up on packages 14 after it has been bulked and heat-set. In the form of the invention shown, twelve yarns 10 are being supplied to be treated but any number can be treated, if desired.

The yarn 10 is supplied by feed rolls 20, 22 and 24 from the packages 12 against the inverted inclined chutes 26 to form coils 28 therein as it is deposited on the endless conveyor 30. The endless conveyor 30 is driven by the motor 32 at a preferred speed of 20 feet/-minute but can be run in the range of 5–50 feet/minute. In continuous fashion, the conveyor transports the yarn 10 in the form of coils 28, sequentially, from the chute 26 to the winder 33, through the hot air ovens 34 and 36, cooling zone 38 and the loop elimination racks 40. To efficiently bulk the yarn 10, it is desired to lay each yarn 10 onto the conveyor 30 in coiled form so that the individual fibers and/or filaments are free to move upon the application of hot air in the bulking oven 34. This is accomplished by a plurality of inverted U-shaped chutes 26 mounted at an angle of approximately 45° to the horizontal adjacent the nip of the feed rolls 20 and 22 to receive yarn therefrom. The chutes 26 are supported in position by pairs of upstanding support members 44 and 46, which respectively, support the rods 48 and 50 which project through perforated supported plates 52 welded or otherwise received to the top of each chute 26. The support members are mounted to side support members 54 and 56 by any suitable means such as screws 58.

The yarn 10 is supplied through eyelets 60 to the nip of the steel feed roll 24 and the rubber roll 22. From the nip of the rolls 22, 24, the yarn 10 passes around the rubber roll 22 into its nip with the lower steel roll 20. From the nip of the rolls 20, 22, each of the yarns 10 is impacted against the inner wall 61 of its respective chute and tends to loop back on itself as it falls downwardly onto the conveyor 30 to form the coils 28.

The coils 28 are conveyed by the conveyor 30 through the bulking oven 34 operating at an air temperature of about 300° F. and the heat setting oven 36 operating at an air temperature of about 400° F. The ovens 34 and 36, basically, are very similar and are as shown in FIGS. 2 and 3. The ovens 34 and 36 basically consist of a housing 62 a cooling fan 64, return duct 66, supply duct 68, a heater 70 and a heater fan 72. The coils 28 are conveyed on the conveyor 30 into the opening 74 at one end of the housing 62 and out the opening 76 in the other end of the housing.

The return duct 66 and the supply duct extend transverse to the direction of travel of the conveyor 30 and are open adjacent the conveyor and the coils 28 of yarn to heat same. The return duct 66 has at least one opening 77 therein to allow gaseous fluid, such as air, to be exhausted therefrom and be recirculated to the inlet of the heater fan. The supply duct 68 also has at least one by-pass opening 79 therein to allow gaseous fluid to exit therefrom and be recirculated to the inlet 80 of the heater fan 72. An exhaust 78 is provided to remove smoke and fumes to an external exhaust duct. A cooling fan 64 having a duct 85 connected to the outlet thereof and to the lower duct 68 is provided to supply cool air to the coils 28 when the conveyor belt 30 has been stopped.

FIG. 2 illustrates the ovens when the conveyor 30 is moving the coiled yarn 28 through the ovens. The damper 84 in the cooling fan duct 85 is closed and the damper 86 in the lower duct 68 is in the position shown. The damper 86 is preferably positioned to pass about 10% of the heated air into the upper area of the duct 68 and 90% of the heated air to the opening 79 to be recirculated. If the conveyor 30 is stopped for any reason, the dampers 84 and 86 are moved to the positions shown in FIG. 3 to prevent damage to the coiled, yarn 28 on the conveyor 30. As can be seen, cold air from the fan 64 is supplied by the duct 84 to the lower duct 68 while hot air from the fan 72 is totally recirculated through the opening 79 to the inlet of the fan 72.

To provide smooth and even flow of air through the coils of yarn 28 on the conveyor, the support structure 88 for he perforated conveyor 30 is employed. As shown in detail in FIG. 4, the stainless steel perforated conveyor belt 30 is supported on a perforated support plate 89 which overlies a 2–2½" thick honeycomb expanded metal sheet 90 tends to straighten out the air flow from the perforated metal sheets 92, 94 and 96, which act as air diffusers, and reduce eddy currents therein.

After the yarn 10 has been bulked and heat-set, the conveyor 30 moves the yarn over the fan 98 which sucks ambient air through the coils of yarn 28 on the perforated conveyor 30 to cool same. Downstream of the cooling fan 98 is a photo-electric sensor 99 which detects the location of yarn coils to control the speed of the winder taking up the yarn from the loop elimination rack 40. The loop elimination rack 40 basically consists of a plurality of posts 100 mounted on the machine frame with rods or rolls 102 mounted between cooperating posts on opposite sides of the machine. As shown in FIG. 2, the yarn passes through the rack 40 for several passes so that the tension exerted by the winder will pull the loops out of the yarn prior to take-up on the packages 14.

It has been found that the bulked yarn produced by the herein described apparatus has an approximate CEAB (crimp extension after boil) of 36%. This yarn is produced at a high rate without excessive application of heat due to the application of dry heat rather than the moisture laden steam employed in prior methods of single end bulking.

Although the preferred embodiment of the invention has been described, it is contemplated that many changes may be made without departing from the scope or spirit of the invention and it is desired that the invention be limited only by the claims.

I claim:

1. Apparatus to provide a bulked, synthetic yarn comprising: a perforated endless conveyor, a first means to supply a synthetic yarn onto said conveyor in coiled form to form loops therein, a bulking oven, a heat setting oven, a loop removal station, means to drive said endless conveyor sequentially through said bulking oven and said heat setting oven to said loop removal station, means to supply a dry gaseous fluid into said bulking oven to bulk the yarn on said endless conveyor, means to supply a dry gaseous fluid into said heating setting oven to heat set the yarn on said endless conveyor and means operably associated with said apparatus to take up the bulked yarn after the loops have been pulled out at the loop removal station, said bulking oven having a means to bypass the heated gaseous fluid from contact with the synthetic yarn when said endless conveyor is stopped and a means to supply cool air onto said endless conveyor when said endless conveyor is stopped.

2. The apparatus of claim 1 wherein said means to supply a synthetic yarn in coiled form includes an inverted U-shaped chute for each yarn mounted above and at an angle to said endless conveyor, said yarn being impelled into said chute and dropping onto said endless conveyor in coiled form.

3. The apparatus of claim 2 wherein said chute is mounted at approximately a 45° angle to said endless conveyor.

4. The apparatus of claim 3 wherein a porous support structure is mounted under said endless conveyor in each of said ovens, said porous support structure including a perforated metal plate, a honeycomb plate adjacent thereto on one side and a plurality of perforated plates on the opposite side of said honeycomb plate to diffuse the incoming dry gaseous fluid and reduce eddy currents therein.

5. The apparatus of claim 4 wherein said means to supply a dry gaseous fluid is located below said endless conveyor and said plurality of perforated plates.

6. Apparatus to provide a bulked, synthetic yarn comprising: a perforated endless conveyor, a first means to supply a synthetic yarn onto said conveyor in coiled form to form loops therein, a bulking oven, a heat setting oven, a loop removal station, means to drive said endless conveyor sequentially through said bulking oven and said heat setting oven to said loop removal station, means to supply a dry gaseous fluid into said bulking oven to bulk the yarn on said endless conveyor, means to supply a dry gaseous fluid into said heating setting oven to heat set the yarn on said endless conveyor and means operably associated with said apparatus to take up the bulked yarn after the loops have been pulled out at the loop removal station, a porous support structure mounted under said endless conveyor in each of said ovens, said porous support structure including a perforated metal plate, a honeycomb plate adjacent thereto on one side and a plurality of perforated plates on the opposite side of said honeycomb plate, said means to supply a dry gaseous fluid being located below said endless conveyor and said plurality of perforated plates whereby said porous support structure diffuses the incoming dry gaseous fluid and reduces eddy currents therein.

* * * * *

UNITED STATES PATENT AND TRADEMARK OFFICE

CERTIFICATE OF CORRECTION

PATENT NO. : 4,955,117

DATED : September 11, 1990

INVENTOR(S) : EDWARD L. CRENSHAW

It is certified that error appears in the above-identified patent and that said Letters Patent is hereby corrected as shown below:

Column 2, line 57, after "90" insert --. This metal sheet 90 --

Signed and Sealed this

Fourteenth Day of January, 1992

*Attest:*

HARRY F. MANBECK, JR.

*Attesting Officer*

*Commissioner of Patents and Trademarks*